United States Patent [19]

Stutzman et al.

[11] Patent Number: 4,993,449

[45] Date of Patent: Feb. 19, 1991

[54] HOSE REEL APPARATUS

[76] Inventors: Larry L. Stutzman, 7181 Hites Cove Rd.; James R. Owings, 2842 Highway 49 S., both of Mariposa, Calif. 95338

[21] Appl. No.: 541,322

[22] Filed: Jun. 21, 1990

[51] Int. Cl.[5] ..... B65H 75/46

[52] U.S. Cl. ..... 137/355.26; 137/355.2; 242/86

[58] Field of Search ..... 137/355.2, 355.21, 355.26; 242/86

[56] References Cited

U.S. PATENT DOCUMENTS

| | | | |
|---|---|---|---|
| 2,039,250 | 4/1936 | Junge | 242/86 |
| 3,175,574 | 3/1965 | Monford | 137/355.26 |
| 3,476,139 | 11/1969 | Guthrie | 137/355.16 |
| 3,977,429 | 8/1976 | Stevenson | 242/86 |
| 4,012,002 | 3/1977 | McDonald et al. | 242/86 |

FOREIGN PATENT DOCUMENTS

| | | | |
|---|---|---|---|
| 357745 | 10/1931 | United Kingdom | 242/86 |
| 668337 | 3/1952 | United Kingdom | 242/86 |

*Primary Examiner*—A. Michael Chambers
*Attorney, Agent, or Firm*—Leon Gilden

[57] ABSTRACT

An apparatus for storage and subsequent unwinding and reeling of an associated hose for use particularly in recreational vehicle application, wherein a flexible hose is wound about a central drum and is in fluid communication with a central spindle. The spindle includes an "L" shaped fluid conduit directed therethrough in communication with an outlet conduit directed exteriorly of the drum. The drum includes a selectively actuated motor driven drive train to effect selective winding and unreeling of the organization by use of a reversible electric motor cooperating with a gear set.

5 Claims, 5 Drawing Sheets

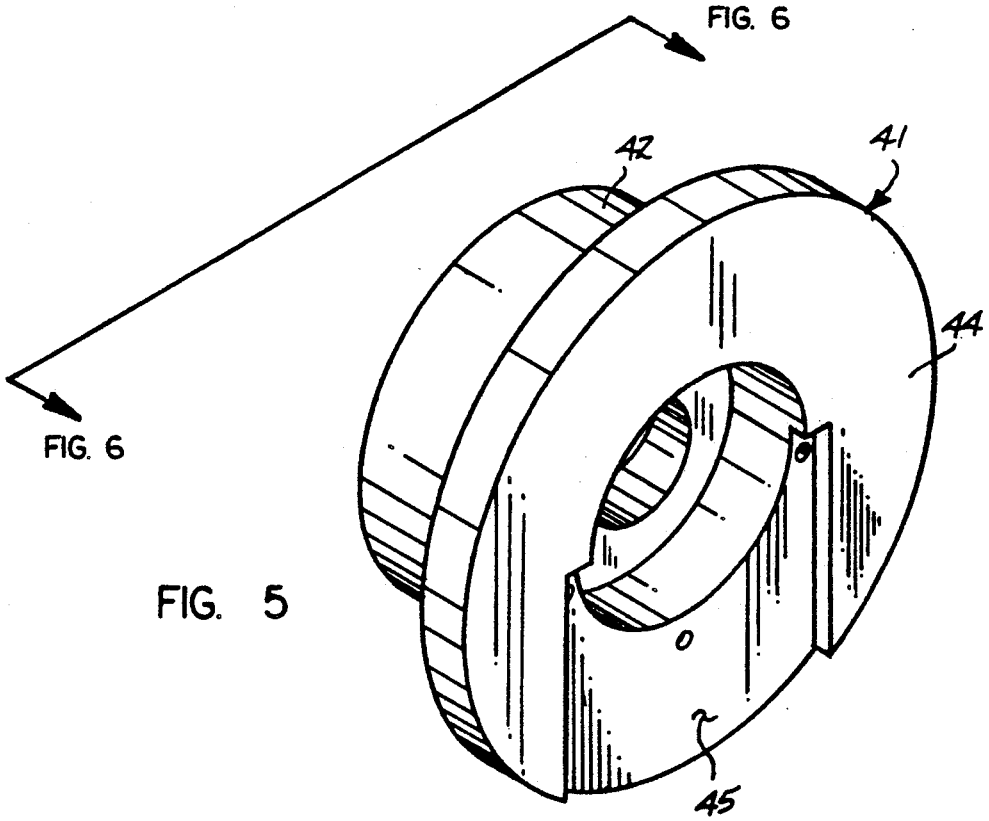
FIG. 5
FIG. 6
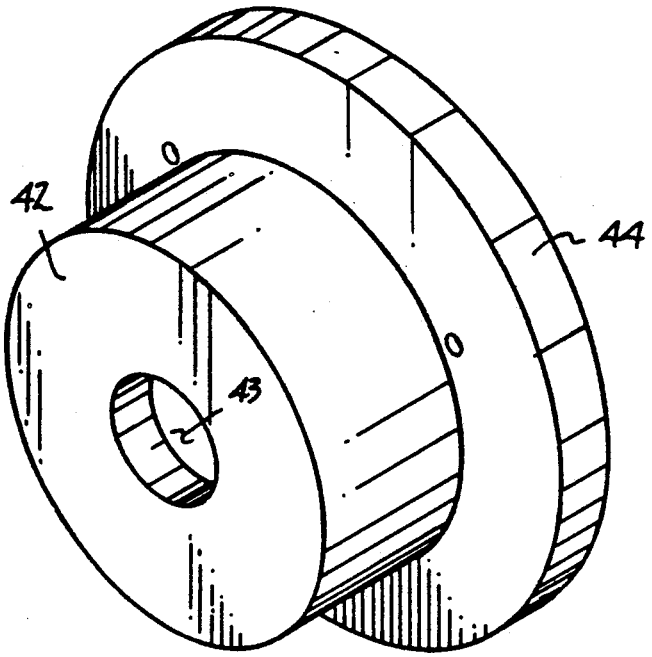

HOSE REEL APPARATUS

BACKGROUND OF THE INVENTION

1. Field of the Invention

The field of invention relates to winding and reeling apparatus, and more particularly pertains to a new and improved hose reel apparatus wherein the same permits selective winding and reeling of a hose to provide fluid communication to an outlet conduit within the organization, as required.

2. Description of the Prior Art

In contemporary use of recreational vehicles, various park facilities provide water sources for use by individuals within a recreational vehicle. Frequently these water sources or faucets are of an inconvenient spacing relative to an associated parking orientation of an associated recreational vehicle. To effect securement of a hose relative to such a faucet, cumbersome and space consuming storage of a hose is required. The instant invention attempts to overcome deficiencies of the prior art by providing a hose in continuous fluid communication with a central support spindle of an associated drum to permit securement of the hose relative to an associated faucet to provide selective water flow through an outlet conduit mounted coaxially through the drum. Examples of prior art hose support apparatus are available in the prior art, but have heretofore failed to provide an organization of an efficient and convenient construction as set forth by the instant invention. For example, U.S. Pat. No. 4,012,002 to McDonald, et al. sets forth a hose reel organization wherein the central drum utilizing a plurality of spaced sprockets directs the drum to wind or reel an associated hose mounted thereabout, but fails to provide the fluid communication conduit organization as required by the instant invention.

U.S. Pat. No. 3,395,723 to Tatsuno provides a drum winding organization for use in directing of gasoline flow in a service station environment.

U.S. Pat. No. 2,301,208 to Gear sets forth a hose reel apparatus providing selective winding and reeling of an associated hose organization.

U.S. Pat. No. 2,954,190 to Le Clair provides a hose winding organization mounted about a central drum.

U.S. Pat. No. 2,573,868 to Newell sets forth a hose reel cooperative with a spaced electric motor to permit selective winding of the hose about the drum in a manner consistent with the prior art.

U.S. Pat. No. 2,963,227 to Lambert provides a hose winding organization utilizing a coaxially arranged fluid conduit cooperative with the hose for use in directing a petroleum product therethrough.

As such, it may be appreciated that there continues to be a need for a new and improved hose reel apparatus wherein the same addresses both the problems of ease of use as well as effectiveness and compactness of construction and in this respect, the present invention substantially fulfills this need.

SUMMARY OF THE INVENTION

In view of the foregoing disadvantages inherent in the known types of hose reel apparatus now present in the prior art, the present invention provides a hose reel apparatus wherein the same provides a compact hose reeling organization utilizing a coaxially arranged conduit cooperative with a central spindle, wherein the spindle utilizes a drive shaft arrangement in communication with a drive gear set to effect selective winding and reeling of the organization. As such, the general purpose of the present invention, which will be described subsequently in greater detail, is to provide a new and improved hose reel apparatus which has all the advantages of the prior art hose reel apparatus and none of the disadvantages.

To attain this, the present invention provides an apparatus for storage and subsequent unwinding and reeling of an associated hose for use particularly in recreational vehicle application, wherein a flexible hose is wound about a central drum and is in fluid communication with a central spindle. The spindle includes an "L" shaped fluid conduit directed therethrough in communication with an outlet conduit directed exteriorly of the drum. The drum includes a selectively actuated motor driven drive train to effect selective winding and unreeling of the organization by use of a reversible electric motor cooperating with a gear set.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose reel apparatus which has all the advantages of the prior art hose reel apparatus and none of the disadvantages.

It is another object of the present invention to provide a new and improved hose reel apparatus which may be easily and efficiently manufactured and marketed.

It is a further object of the present invention to provide a new and improved hose reel apparatus which is of a durable and reliable construction.

An even further object of the present invention is to provide a new and improved hose reel apparatus which is susceptible of a low cost of manufacture with regard to both materials and labor, and which accordingly is then susceptible of low prices of sale to the consuming public, thereby making such hose reel apparatus economically available to the buying public.

Still yet another object of the present invention is to provide a new and improved hose reel apparatus which provides in the apparatuses and methods of the prior art some of the advantages thereof, while simultaneously overcoming some of the disadvantages normally associated therewith.

Still another object of the present invention is to provide a new and improved hose reel apparatus wherein the same permits selective winding and reeling of an associated hose in continuous fluid communication with an output conduit coaxially directed of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a forward mounting disk of the instant invention.

FIG. 6 is an isometric illustration, taken along the lines 6—6 of FIG. 5, illustrating an interior surface of the mounting disk as set forth in FIG. 5.

DESCRIPTION OF THE PREFERRED EMBODIMENT

Figures 1, 2:
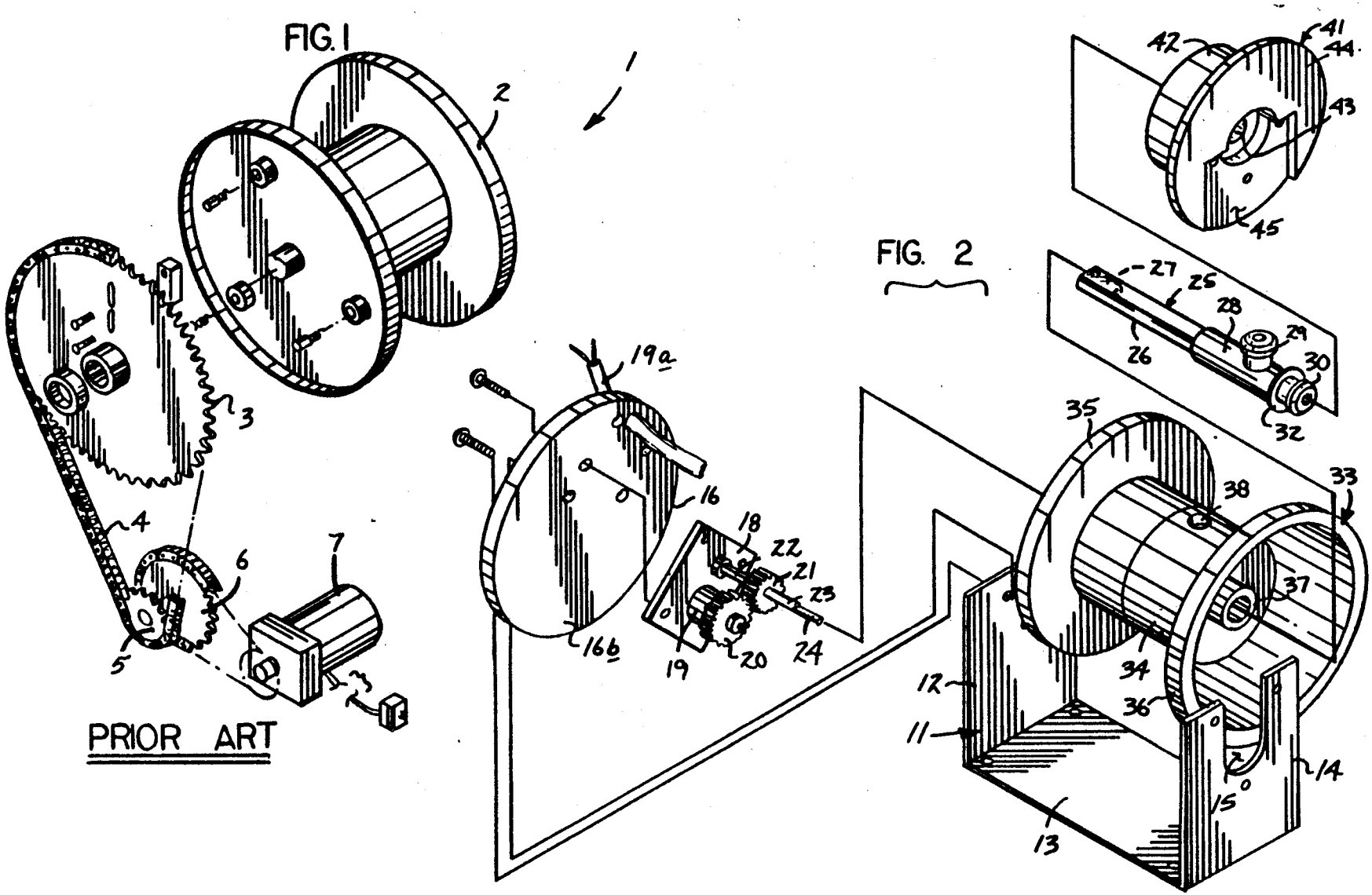
FIG. 2 PRIOR ART
FIG. 1 is an isometric illustration of a prior art hose reel apparatus.
FIG. 2 is an isometric, exploded illustration, of the instant invention.

With reference now to the drawings, and in particular to FIGS. 1 to 10 thereof, a new and improved hose reel apparatus embodying the principles and concepts of the present invention and generally designated by the reference numeral 10 will be described.

FIG. 1 is an isometric illustration of a prior art hose reel apparatus 1 wherein a drum member 2 is in fixed coaxial securement to an upper sprocket 3 that is cooperate with a lower sprocket 5 through a drive chain 4. A further sprocket 6 cooperates with the lower sprocket 5 and an output motor 7 and further drive chain assembly to direct selective winding and reeling of the organization. The elaborate construction of the invention set forth in FIG. 1 limits application to environments of limited space, such as a recreational vehicle application.

Figure 3:
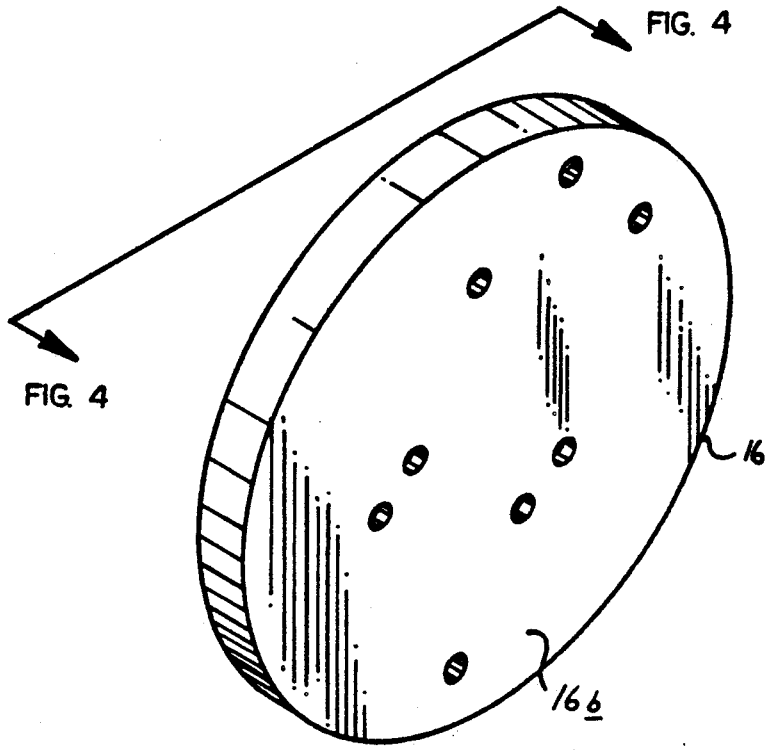
FIG. 3 is an isometric illustration of an interior surface of mounting disk of the organization.
Figure 4:
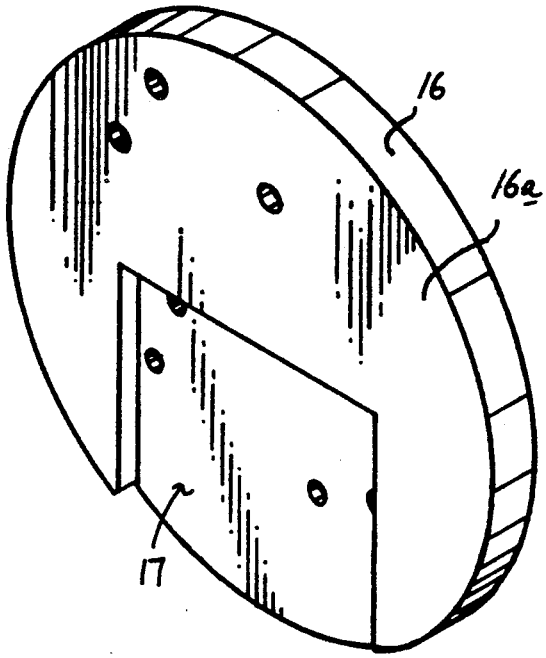
FIG. 4 is an isometric illustration, taken along the lines 4—4 of FIG. 3, illustrating an exterior surface of a mounting disk.
Figure 7:
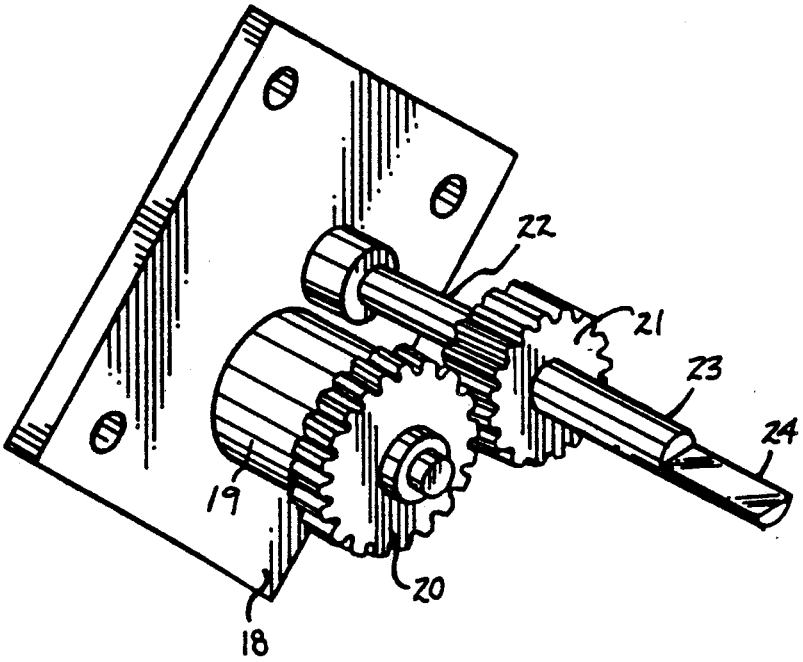
FIG. 7 is an isometric illustration of the drive set utilized by the instant invention.
Figure 8:
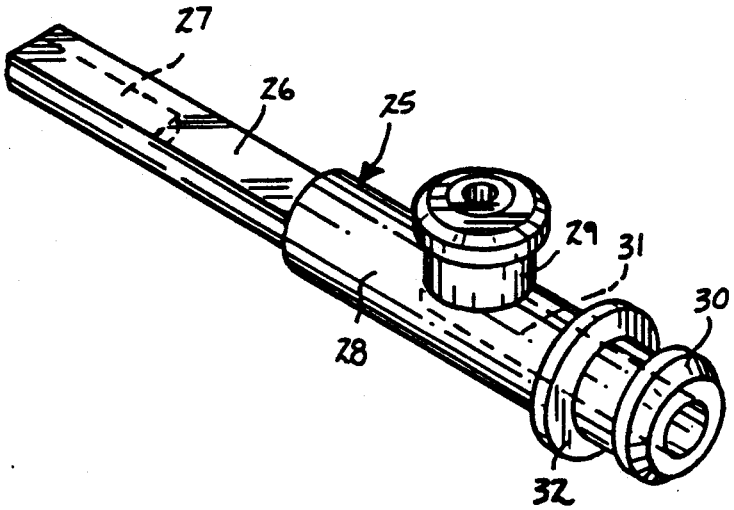
FIG. 8 is an isometric illustration of the spindle utilized by the instant invention.
Figure 9:
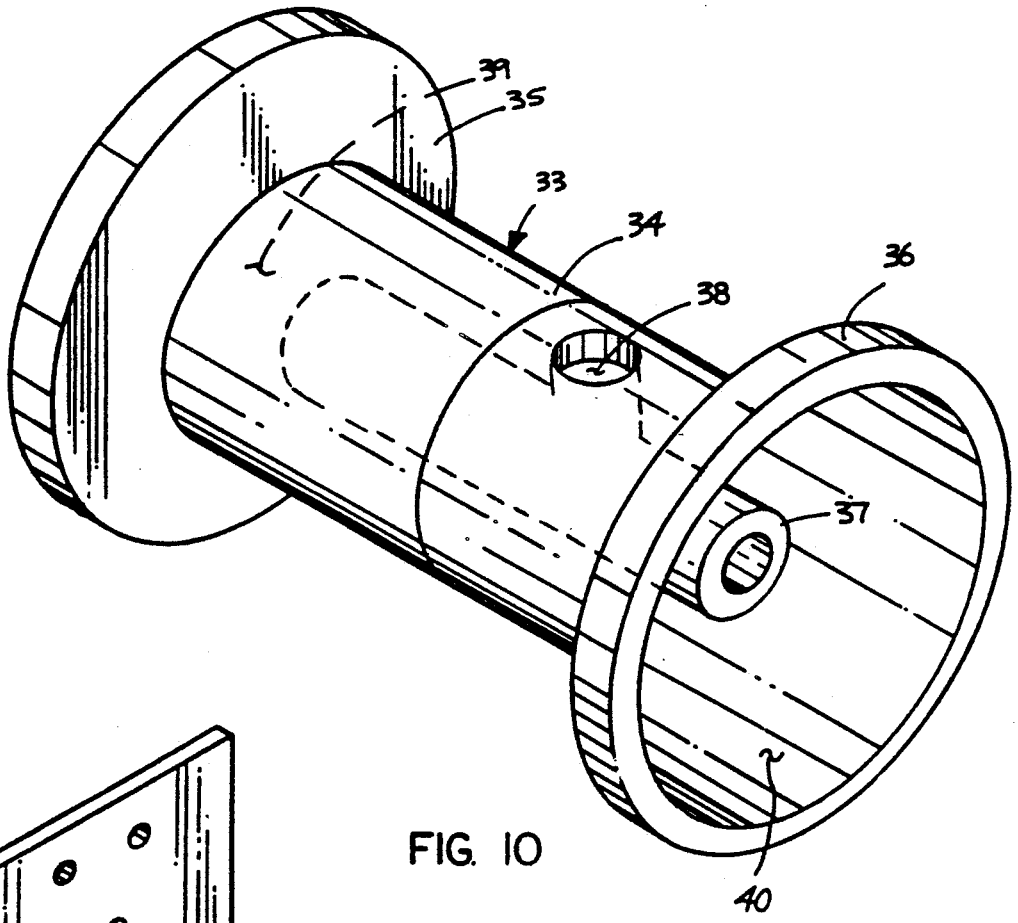
FIG. 9 is an isometric illustration of the drum assembly utilized by the instant invention.
Figure 10:
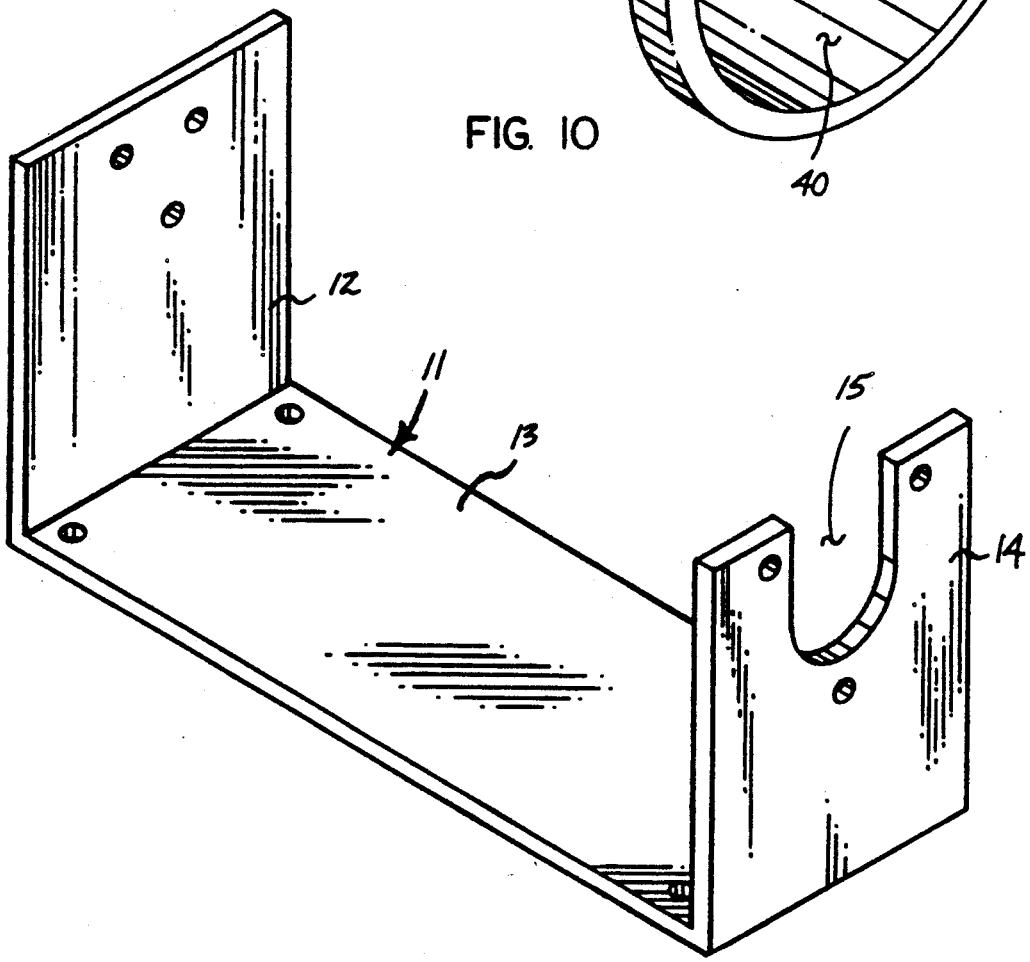
FIG. 10 is an isometric illustration of the support base utilized by the instant invention.

More specifically, the hose reel apparatus 10 of the instant invention essentially comprises a support base 11 including a first vertical support flange 12 spaced from and parallel to a second vertical support flange 14, including a connecting base plate 13 mounted orthogonally between the first and second support flange. The second support flange 14 includes a second flange recess 15 directed downwardly from an upper edge of the second flange 14. The first and second flanges 12 and 14 are of an equal predetermined height. Reference to FIGS. 2 and 3 illustrates the rear mounting disk 16 utilized by the instant invention, including an exterior surface **16*a* spaced from and parallel to an interior surface 16*b*. The exterior surface 16*a* includes a first flange recess 17 of a generally rectangular configuration to receive the first flange 12 therewithin. The first recess 15 is defined by a predetermined length directed diametrically and medially of the disk 16. A matrix of apertures are directed through the disk orthogonally thereto to secure the disk to the associated first flange, and to permit securement of a drive mounting plate 18 onto the interior surface 16*b*. The drive mounting plate 18 includes a reversible electric motor 19 including electric line 19*a* directed through the disk 16 and into electrical communication with motor 19. The electric motor 19 includes an electric motor gear 20 coaxially positioned at a forward output end of the motor 19 in cooperation with a drive gear 21 that is mounted upon a drive gear shaft 22, wherein the drive gear shaft is arranged parallel to an axis defined by the motor 19. The drive gear shaft 22 includes an output shaft 23 extending forwardly and coaxially of the drive gear shaft 22, and further includes a semi-cylindrical stub shaft 24 projecting forwardly of the drive gear shaft 22. The semi-cylindrical stub shaft 24 is received within a complementarily configured stub shaft receiving cavity 27 formed within a rear spindle shaft 26 of the spindle 25 utilized by the instant invention. The spindle 25 includes a forward spindle shaft 28 coaxially aligned relative to the rear spindle shaft 26, with a first hose connector boss 29 arranged orthogonally relative to the forward spindle shaft 28 defining an inlet conduit and in fluid communication through an "L" shaped fluid conduit 31 within the forward spindle shaft 28 in communication with a second hose connector boss 30. The first and second hose connector bosses utilize a "snap-fit" coupler arrangement to secure a hose thereto. The forward spindle shaft 28 includes a forward spindle shaft flange 32 positioned rearwardly of the second hose connector boss 30 to provide axial positioning of the spindle 25 within the support drum 33**, in a manner to be described in more detail below.

The support drum 33 includes a central cylindrical support housing 34, including a rear drum disk 35 and a forward drum disk 36. A central drum support tube 37 is directed coaxially and within the central cylindrical support housing 34 and includes a forward surface to cooperate with the forward spindle support shaft 32 to axially position the shaft 32 therewithin. The stub shaft 24 may include a press-fit within the associated stub shaft receiving cavity 27 of the spindle 25 to effect positioning of the stub shaft, or alternatively may utilize adhesives or mechanical fasteners to effect securement of the stub shaft 24 within the stub shaft receiving cavity 27. A support drum opening radially directed through the central support housing 34 receives a flexible conduit hose (not shown) for securement to the first hose connector boss 29 to effect mechanical engagement of the support drum 33 with the rotatable spindle 25 upon actuation of the electrical drive motor 19. A rear cylindrical cavity 39 receives the electrical motor 19 and the associated gear train therewithin mounted to the rear mounting disk 16. It should be noted that the rear mounting disk 16 is defined by a predetermined diameter substantially equal to a diameter defined by the rear drum disk 35 to provide rear coaxial positioning of the support drum 33. To provide forward positioning of the support drum 33, a forward mounting disk 41 is provided, including a rear cylindrical support collar 42 defined by a first diameter and generally complementary to the forward cylindrical cavity 40, wherein the forward mounting disk 41 further includes a central collar bore 43 coaxially aligned through the forward mounting disk 41 and the support collar 42 to receive the drum support tube 37 and the associated second hose connector boss 30 projecting therethrough. A forward support collar 44 substantially equal to the predetermined diameter of the rear mounting disk 16 further equals the predetermined diameter defined by the forward drum disk 36. A forward support collar second flange recess 45 is formed through a forward face of the forward support collar 44, as defined by the predetermined length of the first recess 15 to receive the second flange 14 therewithin to align the support drum 33 upon the support base 11.

It should be understood that actuation of the electric drive motor 19 in a selective winding and reeling direction rotates the associated spindle 25 and therealong with the support drum 33, with the second connector boss 30 coaxially projecting through the second flange recess 15 to provide a conveniently and coaxially aligned fluid output conduit relative to the support drum 33.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hose reel apparatus comprising, a support base, the support base including a first vertical flange spaced from and parallel a second vertical flange, the second vertical flange including a flange recess directed downwardly from an upper edge of the second vertical flange, and a support drum rotatably mounted on the support base, the support drum including a central cylindrical support housing defined by a first diameter and a rear drum disk spaced from and parallel a forward drum disk, the rear and forward drum disks defined by a second diameter, and the rear and forward drum disks coaxially mounted at opposed terminal ends of the central cylindrical support housing, and the rear drum disk including a rear cylindrical cavity, and the forward drum disk including a forward cylindrical cavity, and a drum support tube coaxially directed through the central cylindrical support housing and extending interiorly of the forward cylindrical cavity, and an elongate axially aligned spindle rotatably mounted within the support tube and extending exteriorly of the tube through the forward cylindrical cavity, and a forward mounting disk mounted within the forward cylindrical cavity, with a forward terminal end of the spindle directed through the forward mounting disk, and a rear mounting disk including a drive means mounted thereto, with the drive means arranged for selective rotation of the spindle, with the drive means mounted within the rear cylindrical cavity, and the rear mounting disk and the forward mounting disk respectively mounted to the first support flange and the second support flange.

2. An apparatus as set forth in claim 1 wherein the spindle includes a rear terminal end and a forward terminal end, the rear terminal end including a stub shaft receiving cavity, and the forward terminal end including an "L" shaped fluid conduit directed therethrough, the "L" shaped fluid conduit including a first connector boss radially aligned with the "L" shaped conduit directed through the spindle, and a second connector boss mounted to the forward terminal end of the spindle in fluid communication with the first connector boss, and a forward spindle shaft flange integrally mounted rearwardly of the second connector boss about the spindle for abutment with the forward terminal end of the support tube, and a support drum opening radially directed through the central cylindrical support housing for alignment with the first connector hose to permit securement of a hose to the first connector boss directed through the support drum opening, and the drive means including a stub shaft securable within the stub shaft receiving cavity of the spindle.

3. An apparatus as set forth in claim 2 wherein the forward mounting disk includes a second flange recess to receive the second flange within the forward support collar, and the rear support flange including a first flange recess to receive the first flange therewithin, and the rear mounting disk and the forward mounting disk defined by the second diameter substantially equal to the same diameter defined by the rear drum disk and the forward drum disk.

4. An apparatus as set forth in claim 3 wherein the motor means includes a motor mounting plate fixedly secured to the rear mounting disk, and a reversible electric motor orthogonally mounted to the motor mounting plate, and a motor drive gear coaxially and forwardly mounted to the motor, and a drive gear in cooperation with the motor gear, and the drive gear coaxially and orthogonally mounted to a drive gear shaft, wherein the drive shaft is orthogonally mounted to the motor mounting plate parallel to an axis defined by the motor, and the drive gear including a drive gear shaft coaxially and forwardly mounted to the drive gear, wherein the drive gear shaft includes a stub shaft coaxially and integrally mounted thereto, wherein the stub shaft is defined by a semi-cylindrical cross-sectional configuration, wherein the semi-cylindrical cross-sectional configuration is complementary to a configuration defined by the stub shaft receiving cavity within the spindle.

5. An apparatus as set forth in claim 4 wherein the forward support collar includes a rear cylindrical support collar defined by a predetermined diameter substantially equal to a further predetermined diameter defined by the forward cylindrical cavity, with the rear cylindrical support collar including a central collar bore coaxially aligned therethrough to receive the drum support tube thereto.

* * * * *